US008777817B2

(12) United States Patent
Finestein et al.

(10) Patent No.: US 8,777,817 B2
(45) Date of Patent: Jul. 15, 2014

(54) CONVERTIBLE PUSH AND PULL EXERCISE MACHINE

(76) Inventors: Ian Finestein, Breinigsville, PA (US); Jeffrey Raimo, Allentown, PA (US)

( * ) Notice: Subject to any disclaimer, the term of this patent is extended or adjusted under 35 U.S.C. 154(b) by 135 days.

(21) Appl. No.: 13/350,988

(22) Filed: Feb. 6, 2012

(65) Prior Publication Data

US 2013/0203566 A1 Aug. 8, 2013

(51) Int. Cl.
*A63B 21/00* (2006.01)

(52) U.S. Cl.
USPC ..... 482/72; 482/70; 482/93; 482/51

(58) Field of Classification Search
USPC ..... 482/72, 70, 93, 109, 73, 111, 112, 57, 482/51
See application file for complete search history.

(56) References Cited

U.S. PATENT DOCUMENTS 4,572,500 A * 2/1986 Weiss ..... 482/73
4,750,735 A 6/1988 Furgerson et al.
4,762,317 A 8/1988 Camfield et al.
4,796,881 A 1/1989 Watterson
5,048,827 A 9/1991 Caruso
5,074,550 A * 12/1991 Sloan ..... 482/29
5,094,446 A * 3/1992 Wiedner ..... 482/72
6,500,099 B1 12/2002 Eschenbach
7,361,124 B1 * 4/2008 Chung-Ting ..... 482/72
7,806,813 B2 10/2010 Campitelli
2005/0176558 A1 * 8/2005 Huang ..... 482/93
2006/0270528 A1 11/2006 Lai

* cited by examiner

*Primary Examiner* — Jerome W Donnelly
(74) *Attorney, Agent, or Firm* — Behravesh & Richmond, PLLC; Arash Behravesh

(57) ABSTRACT

A convertible push and pull exercise machine capable of providing a user with a total body workout using resistance in two lines of motion. The exercise machine can include a base, an adjustable secured seat positioned on the base, and an arm assembly including opposed first and second arm members each having a first end and a second end. The first end of each of the opposed first and second arm members can pivotally be attached to the base. Additionally, the exercise machine can include a resistance arrangement capable of providing a resistance to each of the opposed first and second arm members in at least two lines of motion.

20 Claims, 13 Drawing Sheets

CONVERTIBLE PUSH AND PULL EXERCISE MACHINE

FIELD OF THE INVENTION

The present teachings relate to a convertible push and pull exercise machine. In particular, the present teachings relate to an exercise machine that provides a user with a total body workout using resistance in two lines of motion.

BACKGROUND OF THE INVENTION

Exercise machines are well known and are widely used by the public to build muscle mass and lose fat. Generally, each exercise machine is designed to exercise a particular muscle group. Some exercise machines allow a user to add or remove bulky attachments to provide the user with the option of exercising multiple muscle groups, while employing the same base machine. For example, some bench pressing machines allow a user to connect a leg extension attachment and replace the bench with a seat so that the user can perform leg extension exercises as well. Additionally, these types of exercise machines require the user to change position to perform different exercises.

Several attempts have been made to create an exercise machine that allows a user to simultaneously exercise different muscle groups, while employing the same base machine. For example, U.S. Pat. No. 5,094,446 describes a rowing machine having opposed cylinders to reduce heat build-up in the cylinders and to exercise most of the user's muscles during forward and backward movements. However, due to its design, this type of exercise machine has a very limited use.

Accordingly, a need exists in the industry for an exercise machine that allows a user to simultaneously exercise at least two muscle groups at the same time without requiring the user to substantially change position and/or connect bulky additional attachments.

SUMMARY OF THE INVENTION

The present teachings provide an exercise machine that includes an adjustable secured seat positioned on the base, an arm assembly having opposed first and second arm members each having a first end and a second end, wherein the first end of each of the opposed first and second arm members is pivotally attached to the base, and a resistance arrangement capable of providing a resistance to each of the opposed first and second arm member in at least two lines of motion.

The present teachings provide that the resistance arrangement includes a first resistance device capable of providing resistance to the first arm member in at least two lines of motion and a second resistance device capable of providing resistance to the second arm member in at least two lines of motion. Each of the first and second resistance devices includes a first end and a second end. The first ends of each of the first and second resistance devices are connected to a predetermined location on the base. Furthermore, the second ends of each of the first and second resistance devices are connected to a predetermined location on their respective opposed first and second arm members.

The present teachings provide that the resistance arrangement includes a first resistance device and a second resistance device capable of applying resistance to the opposed first arm member, as well as a third resistance device and a fourth resistance device capable of applying resistance to the opposed second arm member. The first and third resistance devices are capable of providing resistance in a first line of motion and the second and fourth resistance devices are capable of providing resistance in a second line of motion, which is opposite to the first line of motion.

The present teachings provide that the resistance arrangement includes a piston, a friction generating device, an electromagnetic force generating device, or any combinations thereof.

The present teachings provide that the friction generating device is a break system.

The present teachings further provide a structure connecting the opposed arm members to one another.

The present teachings provide that the structure includes a foot securing device.

The present teachings provide that the structure includes a padded area on at least one side of the structure.

The present teachings further provide an anchor that is connected to the base.

The present teachings provide that each of the opposed first and second arm members is telescopic.

The present teachings provide that each of the opposed telescopic first and second arm members includes a resistance device that is capable of providing a resistance in a direction different from the resistance provided by the resistance arrangement.

The present teachings provide that each of the opposed first and second arm members is a resistance device.

The present teachings provide that the resistance device is a piston.

The present teachings provide an exercise machine that includes a base, an arm assembly including opposed telescopic first and second arm members each having a first end and a second end, wherein the first ends of each of the opposed telescopic first and second arm members are attached to the base. The exercise machine also includes a resistance arrangement having a first resistance device capable of applying a resistance to the opposed telescopic first arm member and a second resistance device capable of applying a resistance to the opposed telescopic second arm member, each of the first and second resistance devices includes a first end and a second end, wherein the first ends of each of the first and second resistance devices are connected to the first ends of each of the opposed telescopic first and second arm members and the second ends of each of the first and second resistance devices are connected to the second ends of each of the opposed telescopic first and second arm members, and wherein each of the first and second resistance arrangements is capable of providing a resistance in at least two lines of motion.

The present teachings provide that each of the opposed telescopic first and second arm members includes at least one additional resistance device.

The present teachings provide that each of the at least one additional resistance devices is capable of providing a resistance in a direction different from the resistances provided by the first and second resistance devices.

The present teachings provide that each of the opposed telescopic first and second arm members is a piston.

The present teachings provide an exercise machine that includes at least one telescopic arm having a resistance generating device capable of providing a resistance in at least one lines of motion.

The present teachings provide that the at least one telescopic arm includes a plurality of telescopic sections and wherein at least one of the plurality of telescopic sections includes a resistance adjustment mechanism.

The present teachings provide that the resistance device is capable of providing a resistance in at least two lines of motion.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

The present teachings are directed to a multipurpose exercise machine having a unique push and pull system that allows a user to simultaneously exercise several different muscle groups. For example, the multipurpose exercise machine of the present teachings can be used to simultaneously exercise (i) the pectorial and lateral muscles; (ii) the gluteal, hamstring, and quadricep muscles; (iii) the bicep and tricep muscles; and (vi) the lower back and abdominal muscles, without the user having to substantially change positions and/or connect bulky additional attachments.

Figure 1A:
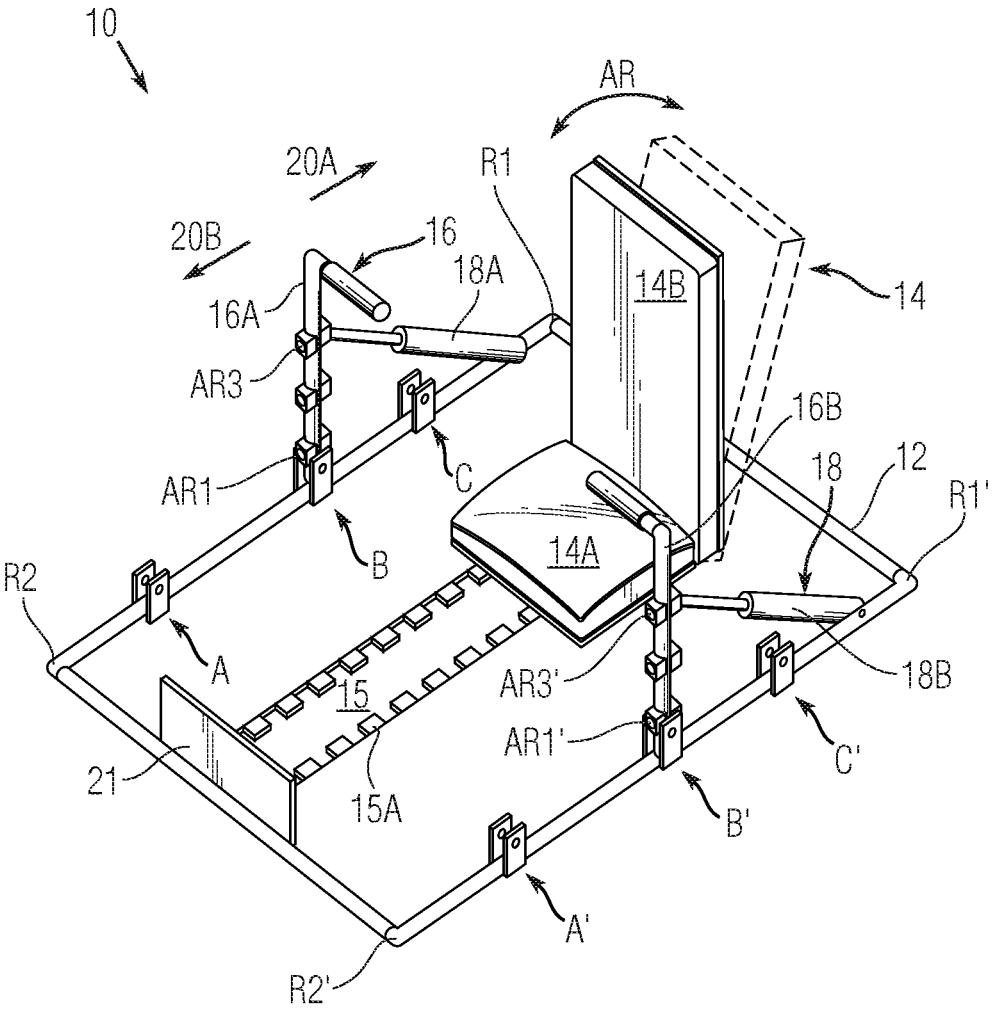
FIG. 1A is a perspective view of an exercise machine of the present teachings according to various embodiments.
Figure 1B:
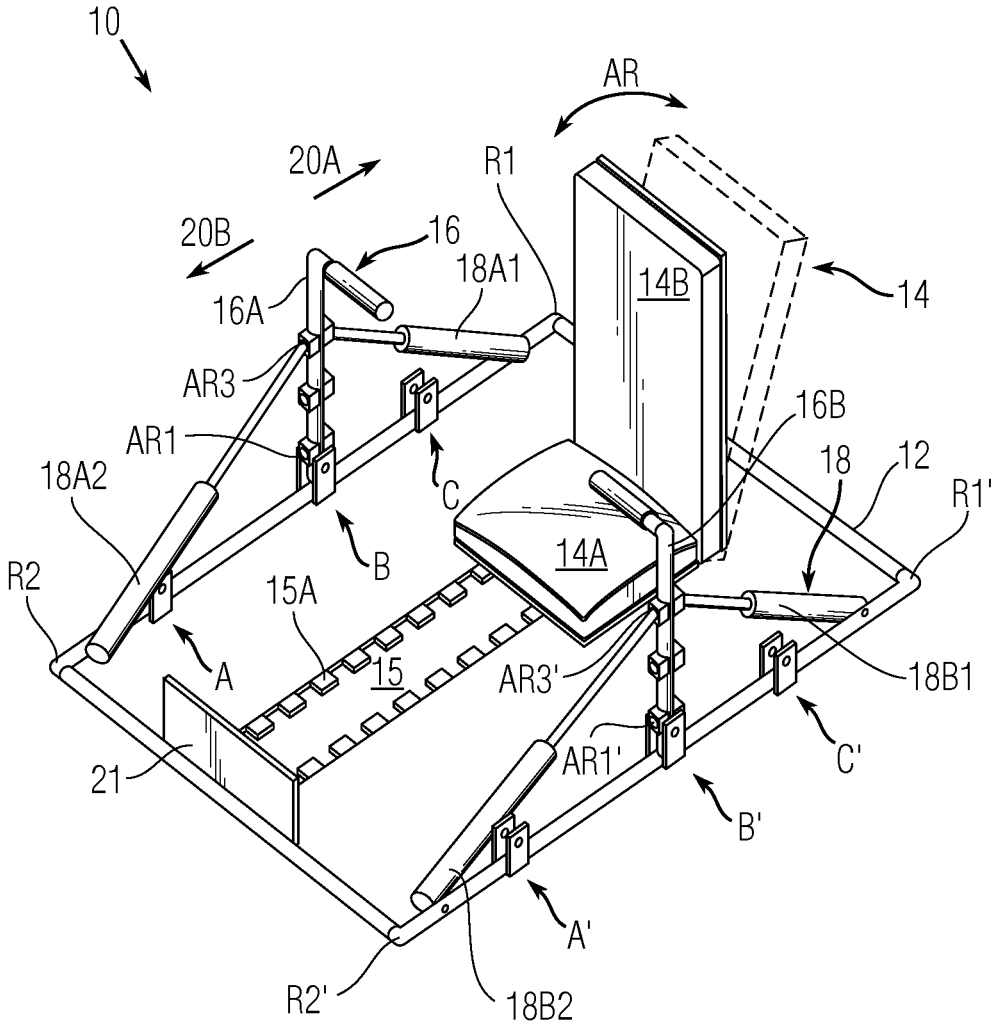
FIG. 1B is a perspective view of an exercise machine of the present teachings according to various embodiments.
Figure 1C:
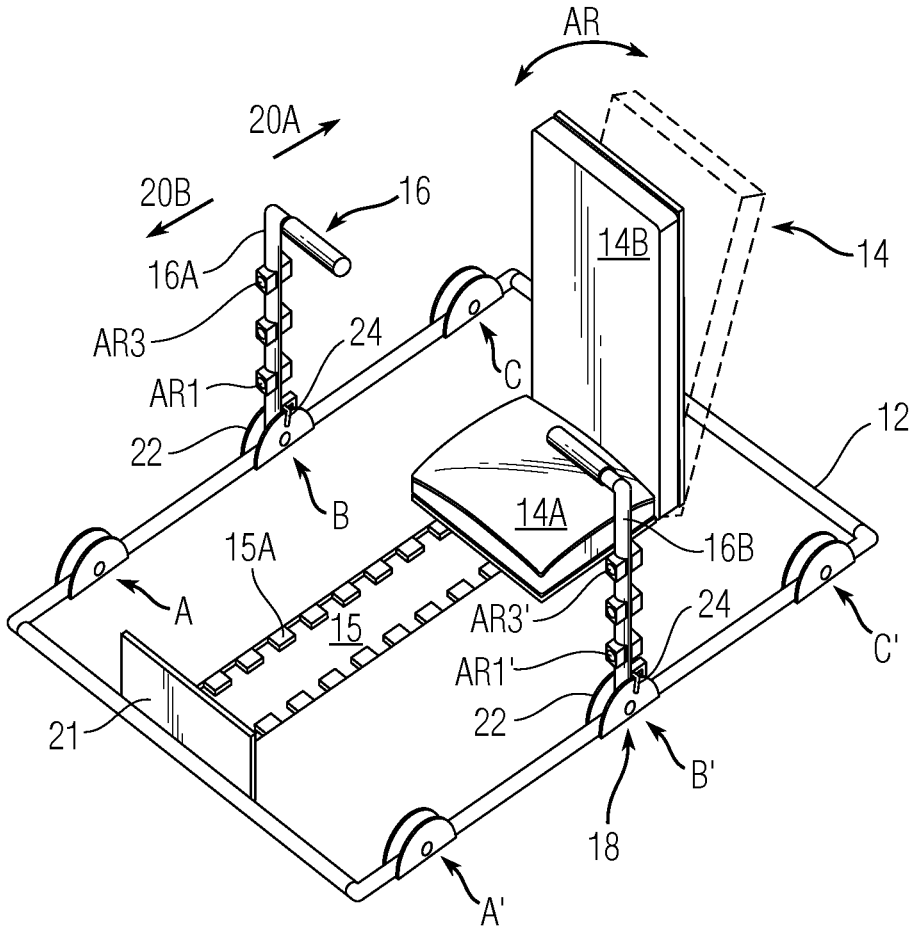
FIG. 1C is a perspective view of an exercise machine of the present teachings according to various embodiments.

Each of FIGS. 1A-1C shows a perspective view of an exemplary embodiment of the exercise machine 10 of the present teachings. The exercise machine 10 can include a base 12 that can accept an adjustable secured seat 14 and an arm assembly 16. The adjustable secured seat 14 can include a bottom portion 14A and a back support portion 14B.

Figure 1D:
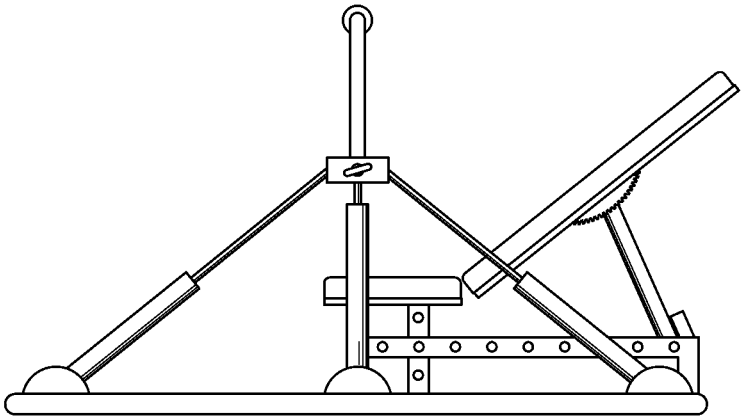
FIG. 1D is a side view of an exercise machine of the present teachings according to various embodiments that includes a inclined seat.
Figure 1E:
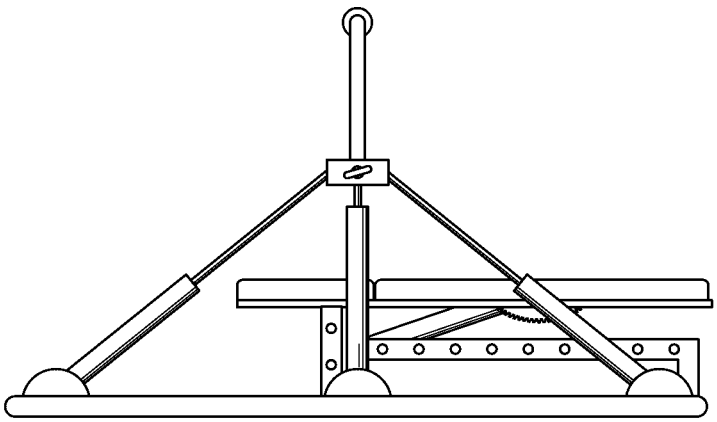
FIG. 1E is a side view of an exercise machine of the present teachings according to various embodiments that includes a flat bench.

The adjustable secured seat 14 is positioned on a rail 15 having securing teeth 15A. A user of the exercise machine 10 can move the adjustable secured seat 14 on the rail 15 by lifting a lever to accommodate his or her height. Once the user has determined the correct seat position, the user can then release the lever to secure the adjustable secured seat 14 to the securing teeth 15A. Furthermore, the back support portion 14B can be adjusted by any method known to one skilled in the art. For example, the back support portion 14B can be lowered in the direction AR (e.g., to a 45° angle) to mimic an inclined bench press machine, as shown in FIG. 1D. Alternatively, it can be lowered in the direction AR (e.g., to a 90° angle) to mimic a flat bench press machine, as shown in FIG. 1E.

The arm assembly 16 of the exercise machine 10 can include opposed first and second arm members 16A and 16B. Each of the opposed first and second arm members 16A and 16B can include a first end and a second end. The first end of each of the opposed first and second arm members 16A and 16B can be pivotally attached to a predetermined location on the base 12, such that the opposed first arm member 16A is facing the opposed second arm member 16B. For example, each of the opposed first and second arm members 16A and 16B can be connected at about locations A, B, C, or therebetween and at about locations A', B', C', or therebetween, respectively.

A resistance arrangement 18 can be in contact with the arm assembly 16. The resistance arrangement 18 is capable of providing an adjustable resistance to each of the arm members 16A and 16B in at least two lines of motion (e.g., in the directions 20A and 20B).

Referring to FIG. 1A, the resistance arrangement 18 can include a first resistance device 18A that can be used in conjunction with the opposed first arm member 16A. Additionally, the resistance arrangement 18 can include a second resistance device 18B that can be used in conjunction with the opposed second arm member 16B. In this exemplary embodiment, each of the first and second resistance devices 18A and 18B includes a first end and a second end. The first end of each of the first and second resistance devices 18A and 18B can be directly or indirectly connected to a predetermined location on the base 12 to provide a desired level of resistance. For example, the first end of the first resistance device 18A can be connected to the base 12 at any location from about location R1 to about location R2. Furthermore, the first end of the second resistance device 18B can be connected to the base 12 at any location from about location R1' to about location R2'.

Additionally, the second end of each of the first and second resistance devices 18A and 18B can be connected to a predetermined location on the opposed first and second arm members 16A and 16B, respectively, to further provide a desired level of resistance. For example, the second end of the first resistance device 18A can be connected to the opposed first arm member 16A at any location from about location AR1 to about location AR3. Furthermore, the second end of the resistance device 18B can be connected to the opposed second arm member 16B at any location from about location AR1' to about location AR3'.

Referring to FIG. 1B, the resistance arrangement 18 can include first, second, third, and fourth resistance devices 18A1, 18A2, 18B1, and 18B2, respectively. The first and second resistance devices 18A1 and 18A2 can be used in conjunction with the opposed first arm member 16A, while the third and fourth resistance devices 18B1 and 18B2 can be used in conjunction with the opposed second arm member 16B. Additionally, the first and third resistance devices 18A1 and 18B1 are capable of providing a resistance in a first line of motion (e.g., in the line of motion 20A), while the second and fourth resistance devices 18A2 and 18B2 are capable of providing a resistance in a second line of motion (e.g., in the line of motion 20B). Preferably, the second line of motion 20B is opposite to the first line of motion 20A.

Each of the first, second, third, and fourth resistance devices 18A1, 18A2, 18B1, and 18B2 can include a first end and a second end. The first end of each of the four resistance devices 18A1 through 18B2 can be connected to a predetermined location on the base 12 to provide a desired resistance. For example, the first end of each of the resistance devices 18A1 and 18B1 can be directly or indirectly connected to the base 12 at any location from about location R1 to about location B and from about location R1' to about location B', respectively. In one exemplary embodiment, the first end of each of the resistance devices 18A1 and 18B1 can be pivotally connected to the base 12. Furthermore, the first end of each of the resistance devices 18A2 and 18B2 can be connected to the base 12 at any location from about location R2 to about location B and from about location R2' to about location B', respectively. Additionally, the first end of each of the resistance devices 18A2 and 18B2 can be pivotally connected to the base 12.

Additionally, the second end of each of the resistance devices 18A1 and 18A2 can be connected to a predetermined location on the opposed first arm member 16A to further provide a desired level of resistance. Moreover, the second end of each of the resistance devices 18B1 and 18B2 can be connected to a predetermined location on the opposed second arm member 16B to further provide a desired level of resistance. For example, the second end of each of the resistance devices 18A1 and 18A2 can be connected to the opposed first arm member 16A at any location from about location AR1 to about location AR3. In one exemplary embodiment, the second end of each of the resistance devices 18A1 and 18A2 can be pivotally connected to the opposed first arm member 16A. Furthermore, the second end of each of the resistance devices 18B1 and 18B2 can be connected to the opposed second arm member 16B at any location from about location AR1' to about location AR3'. Additionally, the second end of each of the resistance devices 18B1 and 18B2 can be pivotally connected to the opposed first arm member 16B.

Each of the exemplary resistance devices shown in FIGS. 1A and 1B can be a piston; however, one or more of the pistons can be substituted for or replaced by a device that can generate a resistance in at least two lines of motion. The resistance can be generated by a friction generating device, such as a break-like system, or by an electromagnetic force generating device to name a few.

Referring to FIG. 1C, the resistance arrangement 18 can include a disc 22 and optionally a caliper assembly 24, having a pad that can come in contact with the disc 22 and a portion of the arm assembly 16. In one example, the arm assembly 16 can include the caliper assembly 24, having a pad positioned such that the pad can come in contact with the disc 22 to provide a desired resistance between the disc 22 and the arm assembly 16. In another example, the arm assembly 16 can include the disc 22 and the resistance arrangement 18 can include the caliper assembly 24. The resistance force in this exemplary embodiment can be changed by turning a knob or adjusting a sliding switch that causes an increase or decrease in friction between the disc 22 and the pads of the caliper 24. Alternatively, the caliper 24 can be replaced by an electromagnetic force generating device. In this alternative example, the disc 22 can include iron-like characteristics. The electromagnetic force generating device can create an electromagnetic force between the disc 22 and the electromagnetic force generating device to create an adjustable resistance. The resistance force in this exemplary embodiment can be changed by turning a knob or adjusting a sliding switch that causes an increase or decrease in force between the disc 22 and the electromagnetic force generating device.

Figure 2:
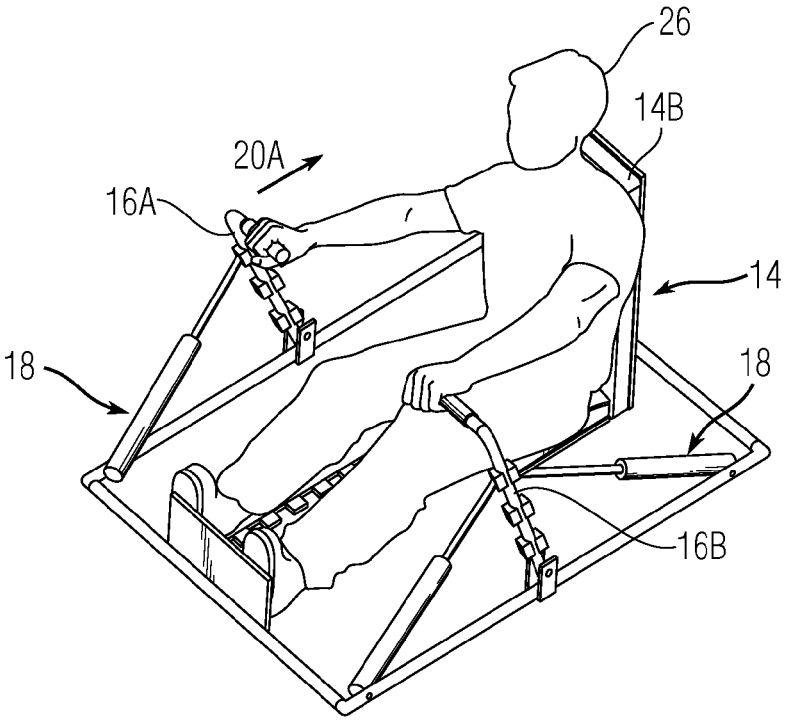
FIGS. 2-4 illustrate a user performing pectorial and lateral muscle exercises using the exercise machine of the present teachings according to various embodiments.
Figure 3:
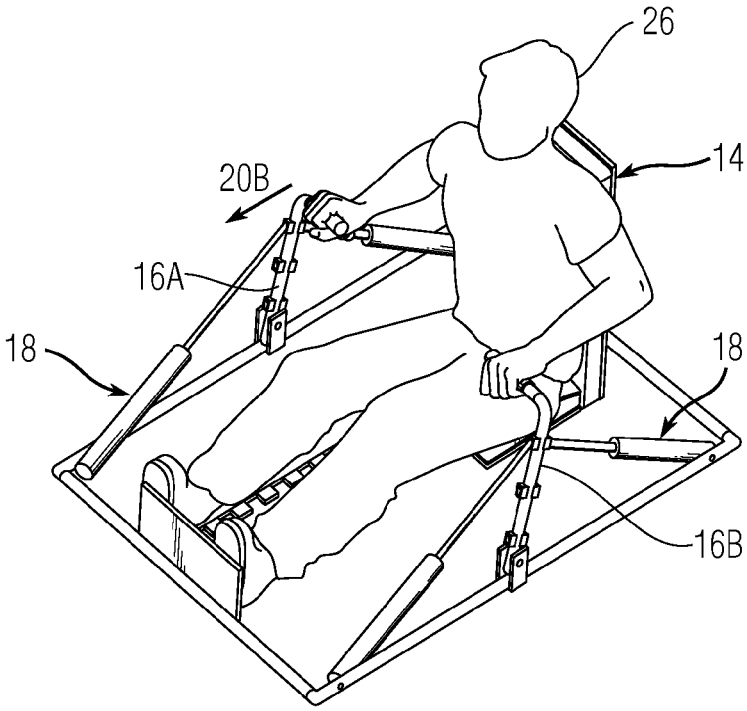
Figure 4:
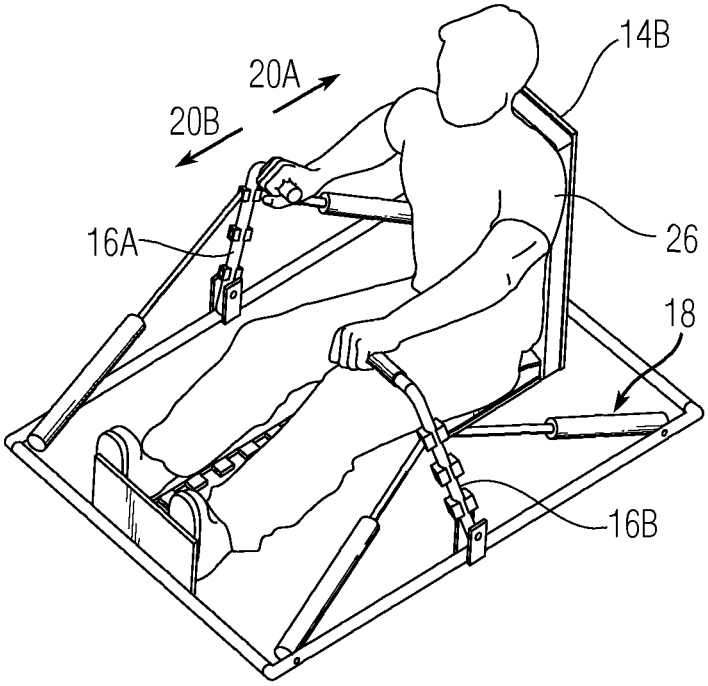

Referring to FIGS. 2 and 3, to perform a combination of pectorial and lateral muscle exercises, a user 26 can sit on the adjustable secured seat 14, place his/her feet on the footrest 21, and grab the opposed first and second arms 16A and 16B. The user 26 can then pull the opposed first and second arms 16A and 16B in the direction 20A (i.e., towards himself/herself) to exercise his/her lateral muscles. Once the opposed first and second arms 16A and 16B are in the vicinity of the user's chest area (as shown in FIG. 3), the user 26 can push the opposed first and second arms 16A and 16B in the direction 20B (i.e., away from himself/herself) to exercise his/her pectorial muscles. The pull and push exercises can be repeated as many times as necessary to fatigue the pectorial and lateral muscles. Alternatively, as shown in FIG. 4, the user 26 can pull on the opposed first arm 16A in the direction 20A and at the same time push on the opposed second arm 16B in the direction 20B to exercise his/her right lateral muscle while, at the same time, exercise his/her left pectorial muscle.

Figure 5A:
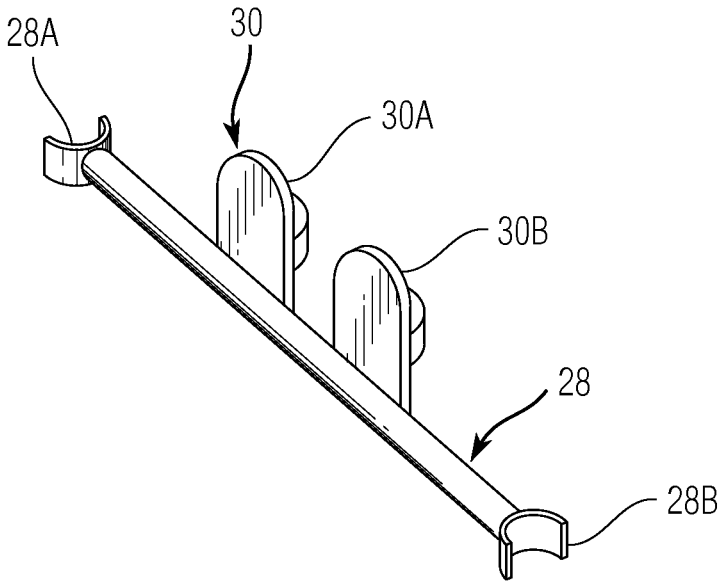
FIGS. 5A and 5B illustrate glutes, hamstrings, and quadriceps muscles exercising attachment according to various embodiments.
Figure 5B:
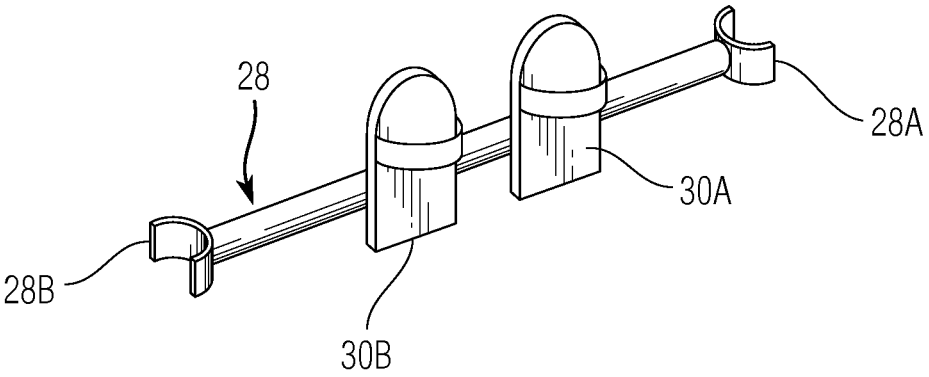

In one exemplary embodiment, a user can exercise his/her gluteal, hamstring, and quadricep muscles without having to substantially change position, rearrange the exercise machine 10, and/or connect bulky additional attachments. To exercise the gluteal, hamstring, and quadricep muscles, the opposed first and second arms 16A and 16B can be connected to one another, using a structure 28 as shown in FIGS. 5A and 5B. The structure 28 can be a plate-like or a rod-like structure that includes a first end 28A, a second end 28B, and an optional foot securing device 30. In one example, the foot securing device 30 can include a first foot securing device 30A and a second foot securing device 30B. Preferably, each of the foot securing devices 30A and 30B is at a predetermined equal distance from the first end 28A and the second end 28B, respectively. The first end 28A can be secured to the opposed first arm 16A and the second end 28B can be secured to the opposed second arm 16B.

Figure 6:
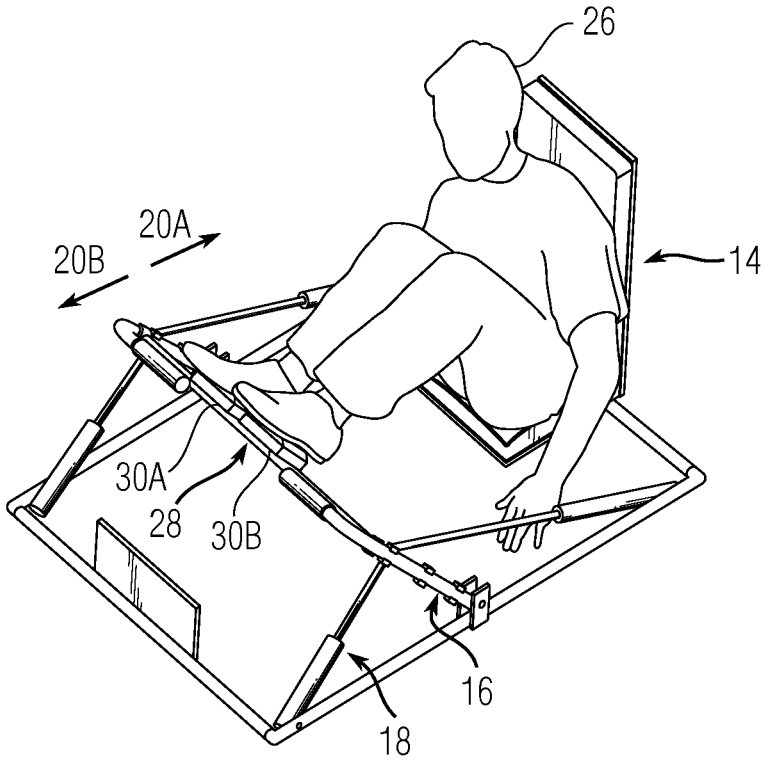
FIG. 6 illustrates a user performing gluteal, hamstring, and quadricep muscles exercises using the exercise machine of the present teachings according to various embodiments.

Referring to FIG. 6, to perform a combination gluteal, hamstring, and quadricep muscle exercises, the user 26 can sit on the adjustable secured seat 14 and secure his/her feet to the first and second securing devices 30A and 30B. Once the user's feet are properly secured, the user can push on the structure 28 in the direction 20B to exercise his/her gluteal and hamstring muscles. The user can then pull on the structure 28, via his/her secured feet, in the direction 20A to exercise his/her quadricep muscle.

Figure 7:
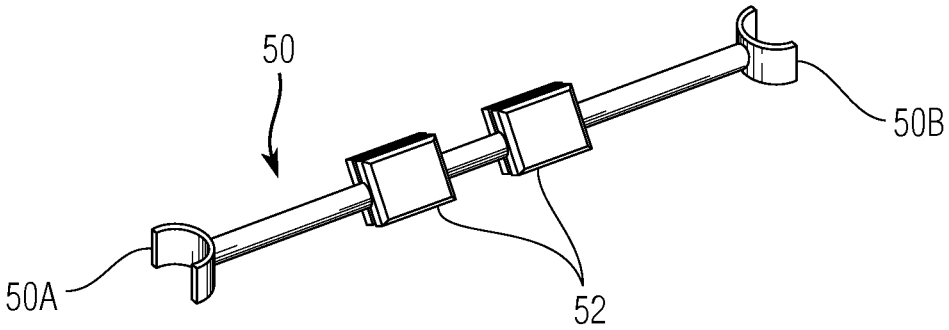
FIG. 7 illustrates lower back muscle and abdominal muscle exercising attachment according to various embodiments.

In another exemplary embodiment, a user can exercise his/her lower back and abdominal muscles without having to substantially change position, rearrange the exercise machine 10, and/or connect bulky additional attachments. To exercise the lower back and the abdominal muscles, the opposed first and second arms 16A and 16B can be connected to one another using an abdominal structure 50 having a padding 52, as shown in FIG. 7. The abdominal structure 50 can include a first end 50A and a second end 50B. The first end 50A can be secured to the opposed first arm 16A and the second end 50B can be secured to the opposed second arm 16B. Preferably, each of the paddings 52 is at a predetermined equal distance from the first end 50A and the second end 50B, respectively. In one exemplary embodiment, structure 28 can include a foot securing device 30 on one side and the padding 52 on the opposite side.

Figure 8:
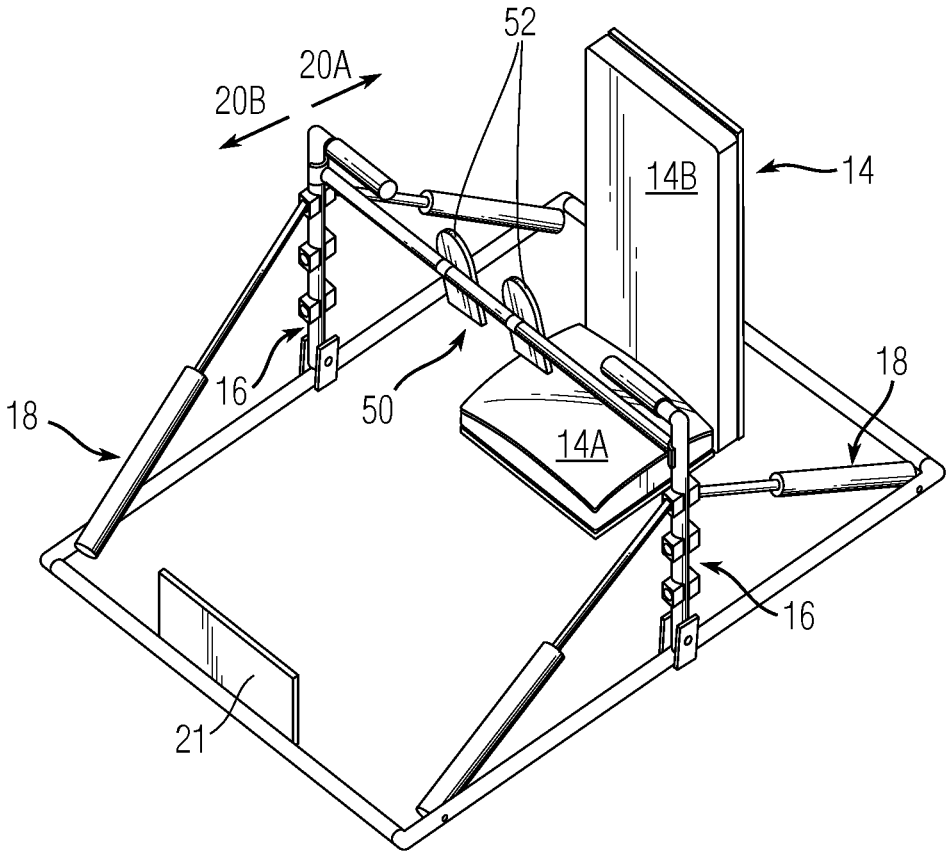
FIG. 8 is a perspective view of an exercise machine of the present teachings with lower back and abdominal muscles exercise attachment according to various embodiments.

Referring to FIG. 8, to perform a combination of abdominal and lower back muscle exercises, the user 26 can sit on the adjustable secured seat 14, hold the structure 50 and lean towards paddings 52, such that each of the paddings 52 are approximately in contact with the user's chest. The user can then push on the paddings 52 in the direction 20B to flex his/her abdominal muscles. The user can then securely hold the structure 50 and pull the structure 50 in the first line of motion 20A to exercise his/her lower back muscles.

Figure 9:
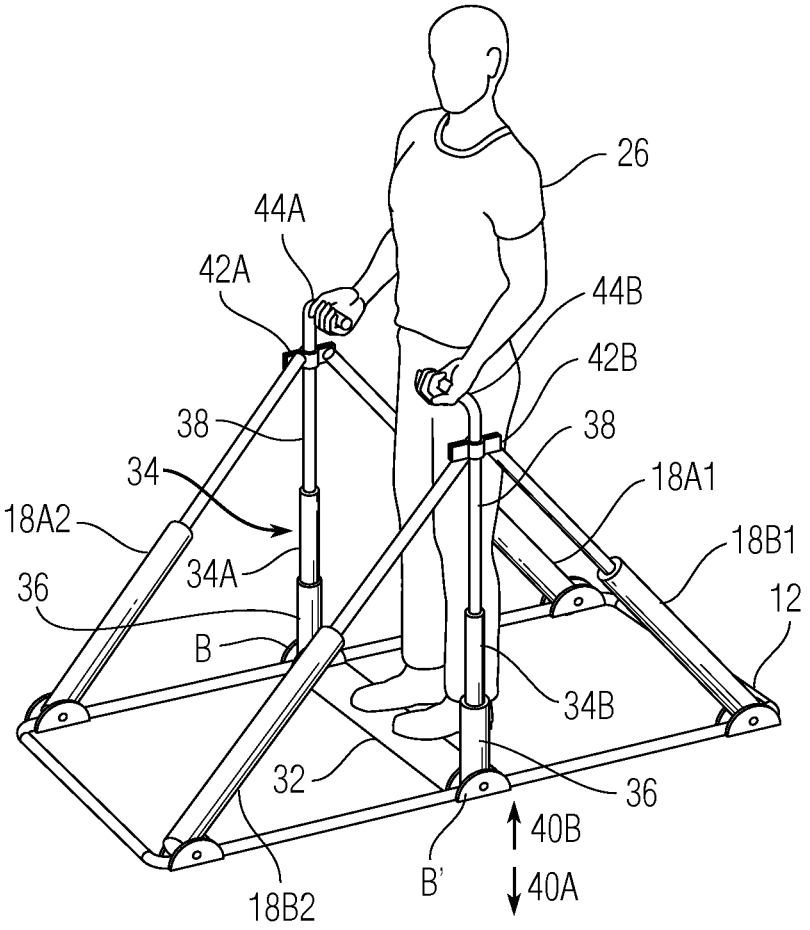
FIG. 9 is a perspective view of an exercise machine of the present teachings according to various embodiments.
Figure 9A:
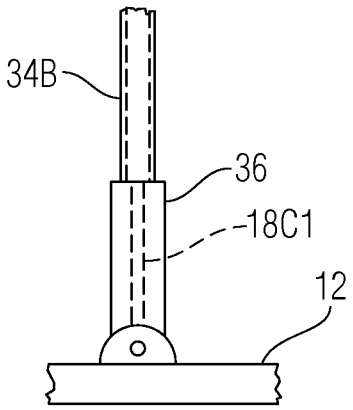
FIG. 9A is a magnified section of a telescopic arm assembly according to various embodiments.

Referring to FIGS. 9 and 9A, the exercise machine 10 can also include an anchor 32 that is connected to the base 12. Additionally, the arm assembly 16 may be a telescopic arm assembly as indicated with roman numeral 34. The telescopic arm assembly 34 can include opposed first and second telescopic arm members 34A and 34B. Each of the opposed first and second telescopic members 34A and 34B can include at least a base section 36 having a first diameter and at least one extending section 38 having a second diameter that is smaller than the first diameter so that the extending section 38 can slide in and out of the base section 36. One end of the base 36 of each of the opposed first and second telescopic arm members 34A and 34B can be attached to a predetermined location on the base 12, such that the opposed first and second telescopic arm members 34A and 34B are facing one another. For example, each of the opposed first and second telescopic arm members 34A and 34B can be connected at locations B and B', respectively.

Still referring to FIGS. 9 and 9A, the resistance arrangement 18 can include first, second, third, fourth, fifth, and sixth resistance devices 18A1, 18A2, 18B1, 18B2, 18C1 and 18C2, respectively. The first and second resistance devices 18A1 and 18A2 can be used in conjunction with the opposed first telescopic arm member 34A. Furthermore, the third and fourth resistance devices 18B1 and 18B2 can be used in conjunction with the opposed second telescopic arm member 34B. In one example, the first, second, third, and fourth resistance devices 18A1, 18A2, 18B1, and 18B2, respectively, are capable of providing resistance in a first line of motion (e.g., in the direction 40A), while the fifth and sixth resistance devices 18C1 and 18C2, respectively, are capable of providing resistance in a second line of motion (e.g., in the direction 40B). Preferably, the second line of motion 40B is opposite to the first line of motion 40A. As shown in FIG. 9A, the resistance devices 18C1 and 18C2 can be positioned in the first and second telescopic arm members 34A and 34B, respectively.

The first end of each of the first, second, third, and fourth resistance devices 18A1, 18A2, 18B1, and 18B2 can be connected to a predetermined location on the base 12, as discussed above with respect to FIG. 1B. The second end of the resistance devices 18A1 and 18A2 can be secured to location 42A of the first telescopic arm member 34A. Similarly, the second end of the resistance devices 18B1 and 18B2 can be secured to location 42B of the second telescopic arm member 34B. Furthermore, the first end of each of the resistance devices 18C1 and 18C2 can be secured in the vicinity of the top portion of the extending section 38, and the second end of each of the resistance devices 18C1 and 18C2 can be secured in the vicinity of the base 12, for example at locations B and B', respectively or in the vicinity of an end of the base section 36.

Each of the exemplary resistance devices shown in FIGS. 9 and 9A can be in the form of a piston; however, one or more of the pistons can be eliminated, substituted for, or replaced by a device that can generate a resistance in at least two lines of motion. The resistance can be generated by friction or by an electromagnetic force to name a few. Alternatively, each of the first and second telescopic arm members 34A and 34B can be a piston or an adjustable friction fitted telescopic device.

Figure 9B:
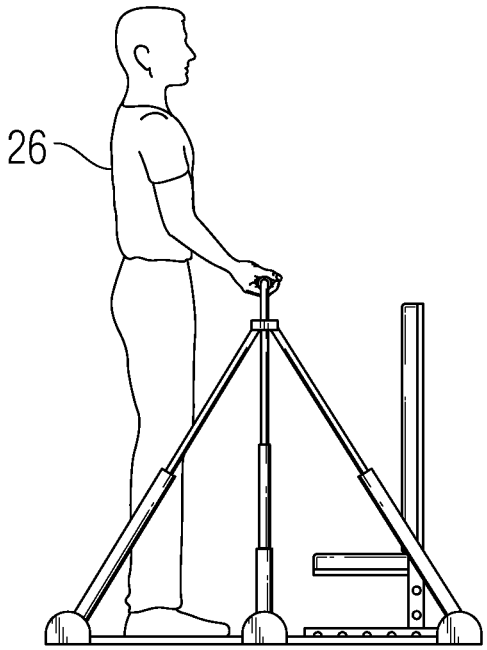
FIGS. 9B-9E illustrate a user performing bicep and tricep muscles exercises using the exercise machine shown in FIG. 9 according to various embodiments.
Figure 9C:
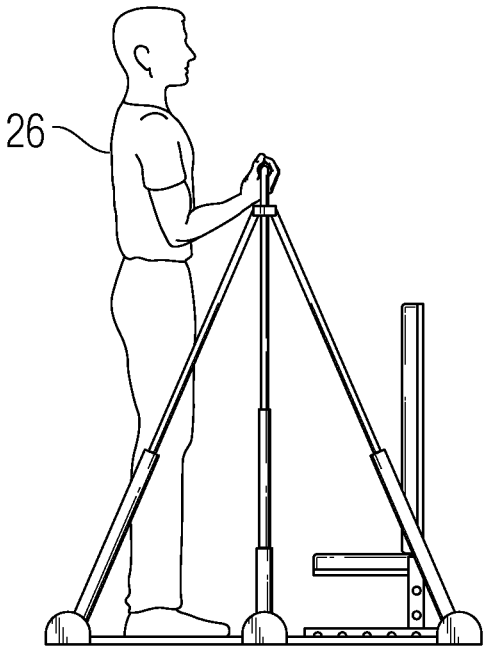
Figure 9D:
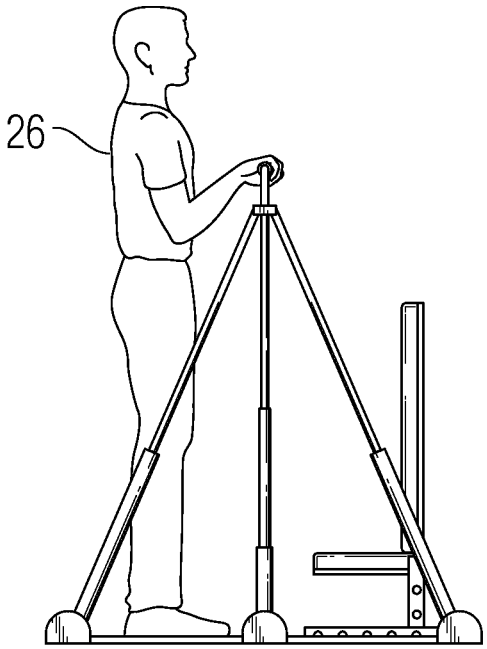
Figure 9E:
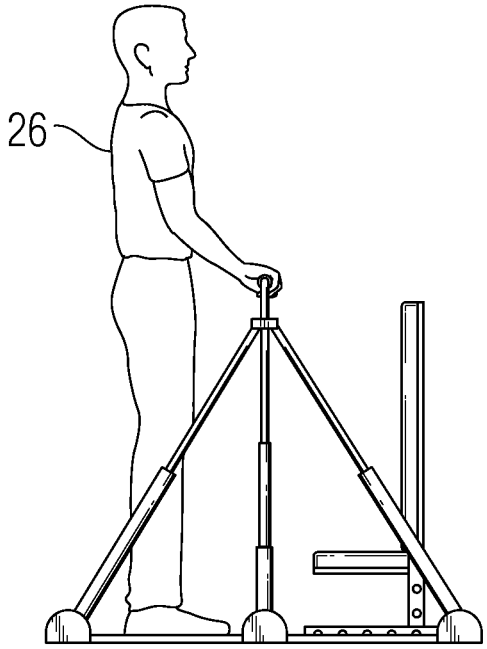

Referring to FIGS. 9B through 9E, to perform a combination of bicep and tricep exercises, the user 26 can stand on the anchor 32 such that the user's weight prevents the exercise machine 10 from moving in any direction. As shown in FIGS. 9, 9B, and 9C, to perform a bicep exercise, the user 26 can hold each of handles 44A and 44B of the opposed first and second telescopic arm members 34A and 34B, such that the palms of the user's hands face upwards. The user can then pull the handles 44A and 44B upwards, starting from the position as shown in FIG. 9B, and ending at the position shown in FIG. 9C. To perform a tricep exercise, the user 26 can hold each of the handles 44A and 44B of the opposed first and second telescopic arm members 34A and 34B, such that the palms of the user's hands face downwards. The user can then push the handles 44A and 44B downwards, starting from the position as shown in FIG. 9D, and ending at the position as shown in FIG. 9E.

Figure 10A:
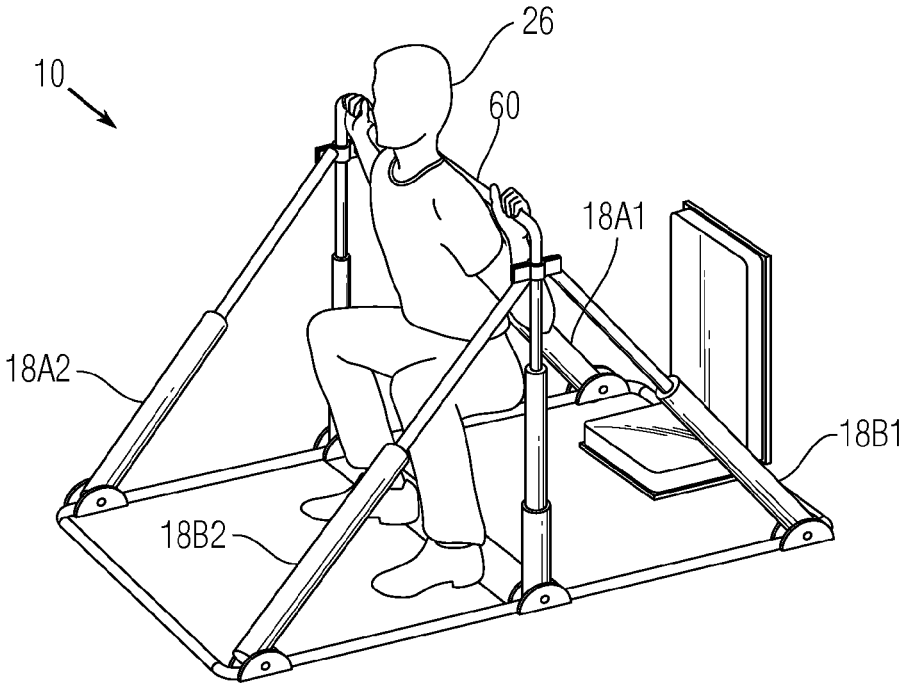
FIGS. 10A and 10B illustrate a user performing squats using the exercise machine of the present teachings according to various embodiments.
Figure 10B:
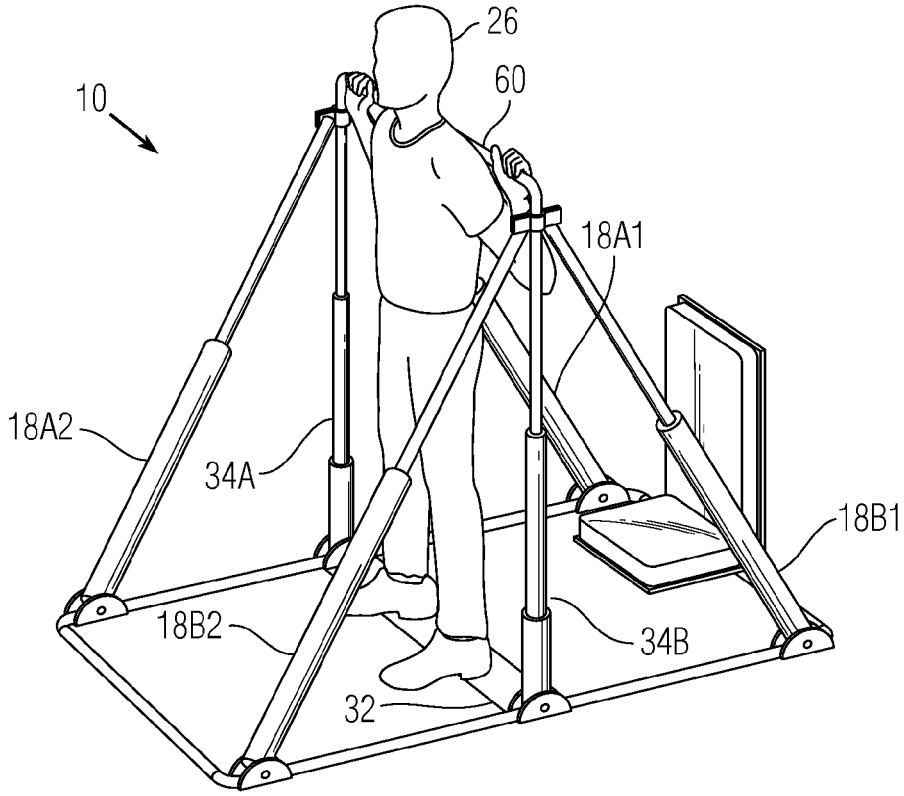

Referring to FIGS. 10A and 10B, the user 26 can also perform squats using the exercise machine 10 of the present teachings. In this exemplary embodiment, a squatting structure 60 can connect the opposed first and second telescopic arm members 34A and 34B to one another. Squatting structure 60 can be as simple as a rod or a structure similar to the abdominal and lower back exercising structure 50 that can include one or more paddings 52. To perform a squat exercise, the user 26 can stand on the anchor 32 in a squatting position and place the squatting structure 60 proximate to his/her shoulder area, as shown in FIG. 10A. The user 26 can then push himself/herself to a standing up position, as shown in FIG. 10B, to exercise his/her legs. In one example, not shown in the figures, each telescopic section of each of the opposed first and second telescopic arm members 34A and 34B are friction fitted. Preferably, the resistance at each telescopic section can be independently changed by the user 26 by turning a knob or changing a setting. This allows the user 26 to provide more friction at certain squatting positions. In another embodiment, each of the opposed first and second telescopic arm members 34A and 34B can include a piston, which provides resistance in at least the line of motion 40B. In another example, each of the opposed first and second telescopic arm members 34A and 34B is a piston resistance device. Optionally, the user 26 can remove the first, second, third, and fourth resistance devices 18A1, 18A2, 18B1, and 18B2 to eliminate or minimize resistance in the line of motion 40B.

From the foregoing description, those skilled in the art can appreciate that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. An exercise machine, comprising:

a base including a rail;

an adjustable seat positioned on the rail and lockably fixed in a predetermined position on the rail;

an arm assembly including opposed first and second arm members each having a first end and a second end, wherein the first end of each of the opposed first and second arm members is pivotally attached to the base;

a resistance arrangement capable of providing a resistance to each of the opposed first and second arm members in at least two lines of motion.

2. The exercise machine of claim 1, wherein the resistance arrangement comprises a first resistance device capable of providing a resistance to the first arm member in at least two lines of motion and a second resistance device capable of providing a resistance to the second arm member in at least two lines of motion, each of the first and second resistance devices includes a first end and a second end, wherein the first ends of each of the first and second resistance devices are connected to a predetermined location on the base and the second ends of each of the first and second resistance devices are connected to a predetermined location on their respective opposed first and second arm members.

3. The exercise machine of claim 1, wherein the resistance arrangement comprises a first and a second resistance devices capable of applying a resistance to the opposed first arm member and a third and a fourth resistance devices capable of applying a resistance to the opposed second arm member, wherein the first and third resistance devices are capable of providing resistance in a first line of motion and the second and fourth resistance devices are capable of providing resistance in a second line of motion opposite to the first line of motion.

4. The exercise machine of claim 1, wherein the resistance arrangement comprises a piston, a friction generating device, an electromagnetic force generating device, or any combinations thereof.

5. The exercise machine of claim 4, wherein the friction generating device is a break system.

6. The exercise machine of claim 1 further comprises a structure connecting the opposed arm members to one another.

7. The exercise machine of claim 6, wherein the structure comprises a foot securing device.

8. The exercise machine of claim 6, wherein the structure includes a padded area on at least one side of the structure.

9. The exercise machine of claim 1, further comprises an anchor connected to the base.

10. The exercise machine of claim 1, wherein each of the opposed first and second arm members is telescopic.

11. The exercise machine of claim 10, wherein each of the opposed telescopic first and second arm members comprises a resistance device that provides a resistance in at least one direction in which the telescopic arm members extend and retract.

12. The exercise machine of claim 1, wherein each of the opposed first and second arm members is a resistance device.

13. The exercise machine of claim 12, wherein the resistance device is a piston.

14. An exercise machine, comprising:

a base;

an arm assembly including opposed telescopic first and second arm members each having a first end and a second end, wherein the first end of each of the opposed telescopic first and second arm members are attached to the base;

a resistance arrangement comprising a first resistance device capable of applying a resistance to the opposed telescopic first arm member and a second resistance device capable of applying a resistance to the opposed telescopic second arm member, each of the first and second resistance devices includes a first end and a second end, wherein the first end of each of the first and second resistance devices is connected to one of the first end of each of the opposed telescopic first and second arm members or the base, and the second end of each of the first and second resistance devices is connected to the second end of each of the opposed telescopic first and second arm members, and wherein each of the first and second resistance devices is capable of providing a resistance in at least one line of motion.

15. The exercise machine of claim 14, wherein each of the opposed telescopic first and second arm members comprises at least one additional resistance device.

16. The exercise machine of claim 15, wherein each of the at least one additional resistance device provides a resistance in a direction substantially perpendicular to a direction in which the telescopic arm members extend and retract.

17. The exercise machine of claim 14, wherein each of the opposed telescopic first and second arm members is a piston.

18. An exercise machine comprising at least one telescopic arm including a resistance generating device positioned within the telescopic arm and capable of providing a resistance in at least one direction in which the telescopic arm members extend and retract.

19. The exercise machine of claim 18, wherein the at least one telescopic arm includes a plurality of telescopic sections and wherein at least one of the plurality of telescopic sections comprises a resistance adjustment mechanism.

20. The exercise machine of claim 18, wherein the resistance device is capable of providing a resistance in at least two lines of motion.

* * * * *